US010064775B2

(12) United States Patent
Matsubara et al.

(10) Patent No.: US 10,064,775 B2
(45) Date of Patent: Sep. 4, 2018

(54) INCUBATOR

(71) Applicant: Atom Medical Corporation, Tokyo (JP)

(72) Inventors: Kazuo Matsubara, Tokyo (JP); Terumi Matsubara, Tokyo (JP); Masato Honda, Saitama (JP); Yutaka Sekiguchi, Saitama (JP); Keisuke Wakabayashi, Saitama (JP)

(73) Assignee: Atom Medical Corporation, Tokyo (JP)

( * ) Notice: Subject to any disclaimer, the term of this patent is extended or adjusted under 35 U.S.C. 154(b) by 219 days.

(21) Appl. No.: 14/955,160

(22) Filed: Dec. 1, 2015

(65) Prior Publication Data

US 2016/0158085 A1 Jun. 9, 2016

(30) Foreign Application Priority Data

Dec. 3, 2014 (JP) ..... 2014-244840

(51) Int. Cl.
*A61G 11/00* (2006.01)

(52) U.S. Cl.
CPC ..... *A61G 11/006* (2013.01); *A61G 2210/50* (2013.01)

(58) Field of Classification Search
CPC ..... A61G 11/00
See application file for complete search history.

(56) References Cited

U.S. PATENT DOCUMENTS

| | | | | |
|---|---|---|---|---|
| 3,858,570 | A * | 1/1975 | Beld | A61G 11/00 392/416 |
| 6,129,703 | A * | 10/2000 | Beneke | A61J 15/0003 604/77 |
| 9,011,313 | B2 | 4/2015 | Matsubara et al. | |
| 2010/0222638 | A1* | 9/2010 | Chilton, III | A61G 11/00 600/22 |
| 2012/0269568 | A1 | 10/2012 | Matsubara et al. | |
| 2013/0185867 | A1* | 7/2013 | Long | A47D 7/04 5/95 |

(Continued)

FOREIGN PATENT DOCUMENTS

| | | |
|---|---|---|
| GB | 1501281 | 2/1978 |
| JP | 2012223320 A | 11/2012 |

OTHER PUBLICATIONS

Office Action dated Jun. 13, 2017, in corresponding Japanese application.

*Primary Examiner* — Thaddeus Cox
(74) *Attorney, Agent, or Firm* — Hunton Andrews Kurth LLP

(57) ABSTRACT

An incubator is provided that prevents damage to the arm of an operator when an arm abuts against the upper end segment of a baby guard relatively hard while inserting the arm into an infant accommodation space. The walls of the baby guards around the infant accommodation space have bent segments that are sufficiently strong to serve as a guard structure on the periphery of the infant accommodation space. Each of the bent segments in the upper end segments of the walls includes an inclined segment and a substantially horizontal segment integrally connected to a distal end of the inclined segment. At least some of the walls can pivot between upward and downward positions, thereby closing or revealing cassette trays.

11 Claims, 10 Drawing Sheets

(56) References Cited

U.S. PATENT DOCUMENTS

2014/0179984 A1* 6/2014 Cipriano ..... A61G 11/009
600/22
2014/0310870 A1* 10/2014 Czach ..... A47D 9/00
5/11

* cited by examiner

INCUBATOR

CROSS-REFERENCE TO RELATED PATENT APPLICATION

This patent application claims priority to Japan Patent Application No. 2014-244840, filed Dec. 3, 2014, the disclosure of which is incorporated herein by reference in its entirety.

TECHNICAL FIELD

The present invention relates to an incubator including baby guards for forming the periphery of an infant accommodation space.

BACKGROUND OF THE INVENTION

A conventional incubator is described in Japanese Patent Laid-Open No. 2012-223320. In the conventional incubator described in Japanese Patent Laid-Open No. 2012-223320, a flat container-shaped bed base is provided on an incubator base. The incubator base is provided with a fixed wall member (or fixed baby guard) which generally forms a wall member on the head side of an infant, a leg-side movable wall member (or movable baby guard) which generally forms a wall member on the leg side of the infant, a left movable wall member (or movable baby guard) which generally forms a wall member on the left side of the infant, and a right movable wall member (or movable baby guard) which generally forms a wall member on the right side of the infant. These wall members are provided in a substantially rectangular shape as a whole when viewed from above. An infant accommodation space having a substantially rectangular parallelepiped shape with an open upper surface is constituted by the bed base (in other words, a mattress on the bed base), the one fixed wall member, and the three movable wall members. Note that each of the one fixed wall member and three movable wall members can take a substantially rectangular shape and can be substantially transparent. In addition, each of the three movable wall members and one fixed wall member can be formed, substantially as a whole, from a substantially transparent plastic plate. Each of the three movable wall members can pivot forward and backward, about pivot support shafts on the left and right sides or the front and rear sides provided in a region including a lower side and its vicinity in the substantially upward position (to be referred to as "the above-described upward position" hereinafter), between the above-described upward position and the substantially downward hanging position (to be referred to as "the above-described hanging position" hereinafter).

In a conventional incubator, the plate thickness of each of the three movable wall members and one fixed wall member for forming an open type incubator is approximately 5 mm. On the other hand, when an operator lays an infant, for example, a newborn infant down on the mattress of the open type incubator or holds up the infant from the mattress, he/she inserts his/her arm to the infant accommodation space. In this case, the arm of the operator can abut against the upper end portion of at least one of the three movable wall members and one fixed wall member. There is the risk that if the arm of the operator abuts against the upper end portion of the wall member relatively hard, the operator feels a pain or the arm gets hurt.

SUMMARY OF THE INVENTION

The present invention effectively solves the above-described problem in the conventional incubator described above.

The present invention relates to an incubator in which at least part of a baby guard includes a bent segment, the bent segment forms an upper end portion of the baby guard while the baby guard is in a substantially upward position, and the bent segment while the baby guard is in the substantially upward position includes an inclined segment integrally connected to an upper end of a substantially upward segment of the baby guard with the bent segment to extend obliquely upward in a direction substantially perpendicular to the substantially upward segment when viewed from above, and a substantially horizontal segment integrally connected to a substantially distal end of the inclined segment to further extend in the same direction as the direction in which the inclined segment extends when viewed from above.

According to a first aspect, the present invention can be configured such that a thickness of the bent segment of the baby guard while the baby guard is in the substantially upward position falls within a range of 3 mm to 14 mm (preferably a range of 4 mm to 12 mm, and more preferably a range of 5 mm to 10 mm), a height of the bent segment while the baby guard is in the substantially upward position falls within a range of 21 mm to 39 mm (preferably a range of 23 mm to 37 mm, and more preferably a range of 25 mm to 35 mm), and a length in a direction from an inside to an outside of the bent segment while the baby guard is in the substantially upward position falls within a range of 10 mm to 30 mm (preferably a range of 13 mm to 27 mm, and more preferably a range of 15 mm to 25 mm). According to a second aspect, the present invention can be configured such that the baby guard comprises four baby guards including a front baby guard, a rear baby guard, a left baby guard, and a right baby guard, where at least three movable baby guards of the four baby guards can individually pivot forward and backward between the substantially upward position and a position except for the substantially upward position, and an upper end segment of each of the at least three movable baby guards in the substantially upward position forms the bent segment along a substantially full length of the upper end segment.

According to a third aspect, the present invention can be configured such that the inclined segment extends toward an outside of an infant accommodation space when viewed from above, and the substantially horizontal segment further extends toward the outside of the infant accommodation space from the distal end of the inclined segment. According to a first mode of the third aspect, the present invention can be configured such that the bent segment while the baby guard is in the substantially upward position includes a second inclined segment integrally connected to the substantially horizontal segment on an opposite side of the inclined segment when viewed from above at a distal end of the substantially horizontal segment on the opposite side of the inclined segment, and the second inclined segment while the baby guard is in the substantially upward position extends obliquely downward toward a substantially outside from the substantially horizontal segment. According to a first case of the first mode of the third aspect, the present invention can be configured such that the bent segment, while the baby guard is in the substantially upward position, includes a hanging segment integrally connected to the second inclined segment on the opposite side of the substantially horizontal segment at a substantially distal end of the second inclined segment on the opposite side of the substantially horizontal segment, and the hanging segment, while the baby guard is in the substantially upward position, extends substantially downward from the second inclined segment.

According to the first mode of the first aspect, the present invention can be configured such that a length of each of a first baby guard and a second baby guard of the four baby guards, which face each other, is longer than a length of each of a third baby guard and a fourth baby guard of the four baby guards, which face each other, the length of each of the first baby guard and the second baby guard falls within a range of 500 mm to 830 mm (preferably a range of 530 mm to 800 mm, and more preferably a range of 560 mm to 760 mm), the length of each of the third baby guard and the fourth baby guard falls within a range of 340 mm to 560 mm (preferably a range of 360 mm to 545 mm, and more preferably a range of 380 mm to 530 mm), a ratio of the length of each of the first baby guard and the second baby guard to the length of each of the third baby guard and the fourth baby guard falls within a range of 1.2 to 1.8 (preferably a range of 1.25 to 1.7, and more preferably a range of 1.3 to 1.6), a length in a substantially vertical direction of each of the first baby guard, the second baby guard, the third baby guard, and the fourth baby guard in the substantially upward position falls within a range of 175 mm to 340 mm (preferably a range of 190 mm to 320 mm, and more preferably a range of 200 mm to 300 mm), each of the first baby guard, the second baby guard, the third baby guard, and the fourth baby guard is curved to protrude in an arc shape toward an outside when viewed substantially from above in the substantially upward position, a length in a thickness direction of an inside surface of each of the first baby guard and the second baby guard falls within a range of 19 mm to 37 mm (preferably a range of 21 mm to 35 mm, and more preferably a range of 23 mm to 33 mm), a length in a thickness direction of an inside surface of each of the third baby guard and the fourth baby guard falls within a range of 16 mm to 34 mm (preferably a range of 18 mm to 32 mm, and more preferably a range of 20 mm to 30 mm), a ratio of the length in the thickness direction of the inside surface of each of the first baby guard and the second baby guard to the length of each of the first baby guard and the second baby guard falls within a range of 0.025 to 0.06 (preferably a range of 0.03 to 0.055, and more preferably a range of 0.035 to 0.05), and a ratio of the length in the thickness direction of the inside surface of each of the third baby guard and the fourth baby guard to the length of each of the third baby guard and the fourth baby guard falls within a range of 0.035 to 0.08 (preferably a range of 0.04 to 0.075, and more preferably a range of 0.045 to 0.07).

According to a fourth aspect, the present invention can be configured such that each of the movable baby guards includes a supporting member pivotably attached to an incubator base, and a baby guard main body attached to the supporting member and supported by the supporting member, the baby guard main body includes a thick portion whose longitudinal section in a direction substantially perpendicular to the baby guard main body has a substantially triangular shape, the thick portion swells from a bottom of an inside surface and an outside surface of the baby guard main body, and a lower surface of the thick portion is in contact with a cover member covering a proximal end of the baby guard main body from an opposite side of the supporting member. According to the first mode of the fourth aspect, the present invention can be configured such that a thickness of the baby guard main body gradually increases upward from an upper end of the thick portion to a lower end of the bent segment while each of the movable baby guards is in the substantially upward position, and a thickness of the bent segment increases to be substantially equal to a thickness of the lower end of the bent segment. According to the first mode of the second aspect, the present invention can be configured such that the incubator comprises a cassette tray accommodation space formed between an incubator base and a bed base, the cassette tray accommodation space includes at least three tray loading/unloading ports selected from a front tray loading/unloading port, a rear tray loading/unloading port, a left tray loading/unloading port, and a right tray loading/unloading port, the at least three tray loading/unloading ports are closed by the at least three movable baby guards, respectively, in a backward pivoting state in which each of the at least three movable baby guards is in the substantially upward position, and the at least three tray loading/unloading ports corresponding to the at least three movable baby guards or wall members are opened when each of the at least three movable baby guards pivots forward in a substantially hanging direction (or downward position).

According to the present invention, it is possible to obtain the first effect where an operator inserts his/her arm to the infant accommodation space to lay an infant, for example, a newborn infant down on the mattress of the incubator or hold up the infant from the mattress, even if the arm of the operator abuts against the upper end segment of the baby guard relatively hard, it is possible to avoid the risk that the operator feels a pain or the arm gets hurt. In addition, according to the present invention, it is possible to obtain the second effect in which the baby guards with the bent segments can have a sufficient strength as the peripheral guards of the infant accommodation space since each bent segment includes the inclined segment and the substantially horizontal segment.

According to each of the first aspect, the second aspect, and the first mode of the first aspect of the present invention, it is possible to more satisfactorily obtain the first and second effects described above. According to the third aspect of the present invention, it is possible to more satisfactorily obtain the first effect obtained according to the present invention. According to each of the first mode of the third aspect and the first case of the first mode of the third aspect of the present invention, it is possible to more satisfactorily obtain the second effect obtained according to the present invention. According to the fourth aspect of the present invention, with a relatively simple arrangement, it is possible to relatively effectively prevent foreign substances such as dirty water or dust from entering at least a portion between the baby guard main body and the cover member out of a portion between the supporting member and the baby guard main body and the portion between the baby guard main body and the cover member. According to the first mode of the fourth aspect of the present invention, each bent segment has a stable appearance in design and has a higher strength. In addition, it is possible to decrease the weight of each movable baby guard, and reduce raw materials such as a plastic material.

Furthermore, according to the first mode of the second aspect of the present invention, tray loading/unloading ports are respectively provided on at least three of the front, rear, left, and right sides of the cassette tray accommodation space. Consequently, even if a doctor or nurse performs an operation in a region including one or two of the three tray loading/unloading ports and its vicinity or their vicinities in a region including the cassette tray accommodation space and its vicinity, he/she can readily store or take out a cassette tray in or from the cassette tray accommodation space through the remaining one tray loading/unloading port or one of the remaining two tray loading/unloading ports. Furthermore, even if a bulky article such as a bulky medical apparatus exists in the region including one or two of the three tray loading/unloading ports and its vicinity or their vicinities in the region including the cassette tray accommodation space and its vicinity, it is possible to relatively readily store or take out the cassette tray in or from the cassette tray accommodation space through the remaining one tray loading/unloading port or one of the remaining two tray loading/unloading ports.

The above, and other, objects, features and advantages of this invention will become readily apparent from the following detailed description thereof which is to be read in connection with the accompanying drawings.

DETAILED DESCRIPTION OF THE INVENTION

A specific preferred embodiment and first to third modified embodiments in which the present invention are applied to an open type incubator (or infant warmer) will be described in "1. Overall Schematic Arrangement of Incubator", "2. Arrangements of Movable Wall Member Structure and Fixed Wall Member Structure", "3. Arrangement of Cassette Tray Mounting Structure", "4. Operations of Movable Wall Member Structure and Fixed Wall Member Structure", and "5. Operation of Cassette Tray Mounting Structure", respectively, with reference to the accompanying drawings.

1. Overall Schematic Arrangement of Incubator

Figure 1:
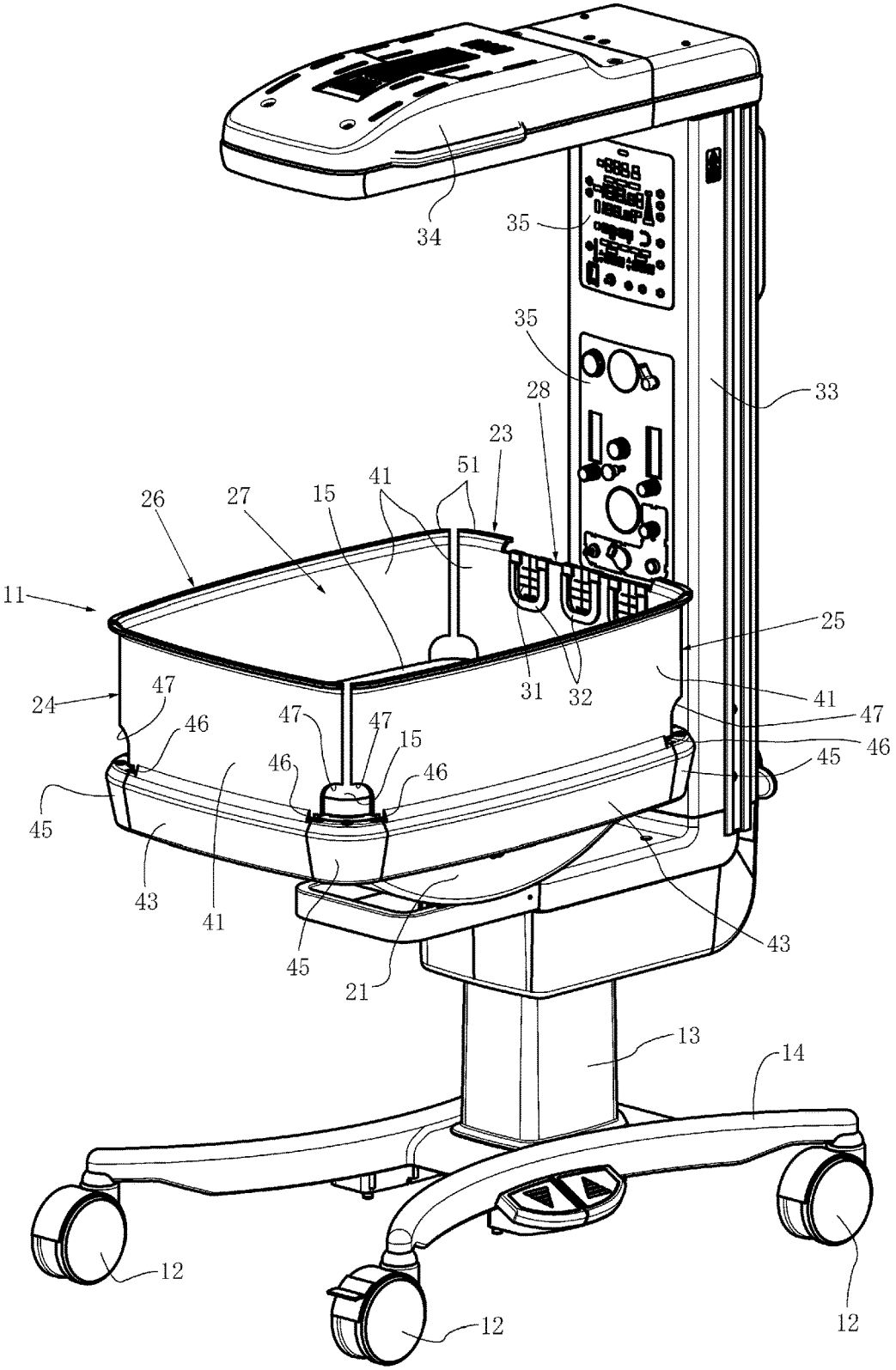
FIG. 1 is a perspective view showing an open type incubator in a normal use state according to an embodiment to which the present invention is applied.
Figure 2:
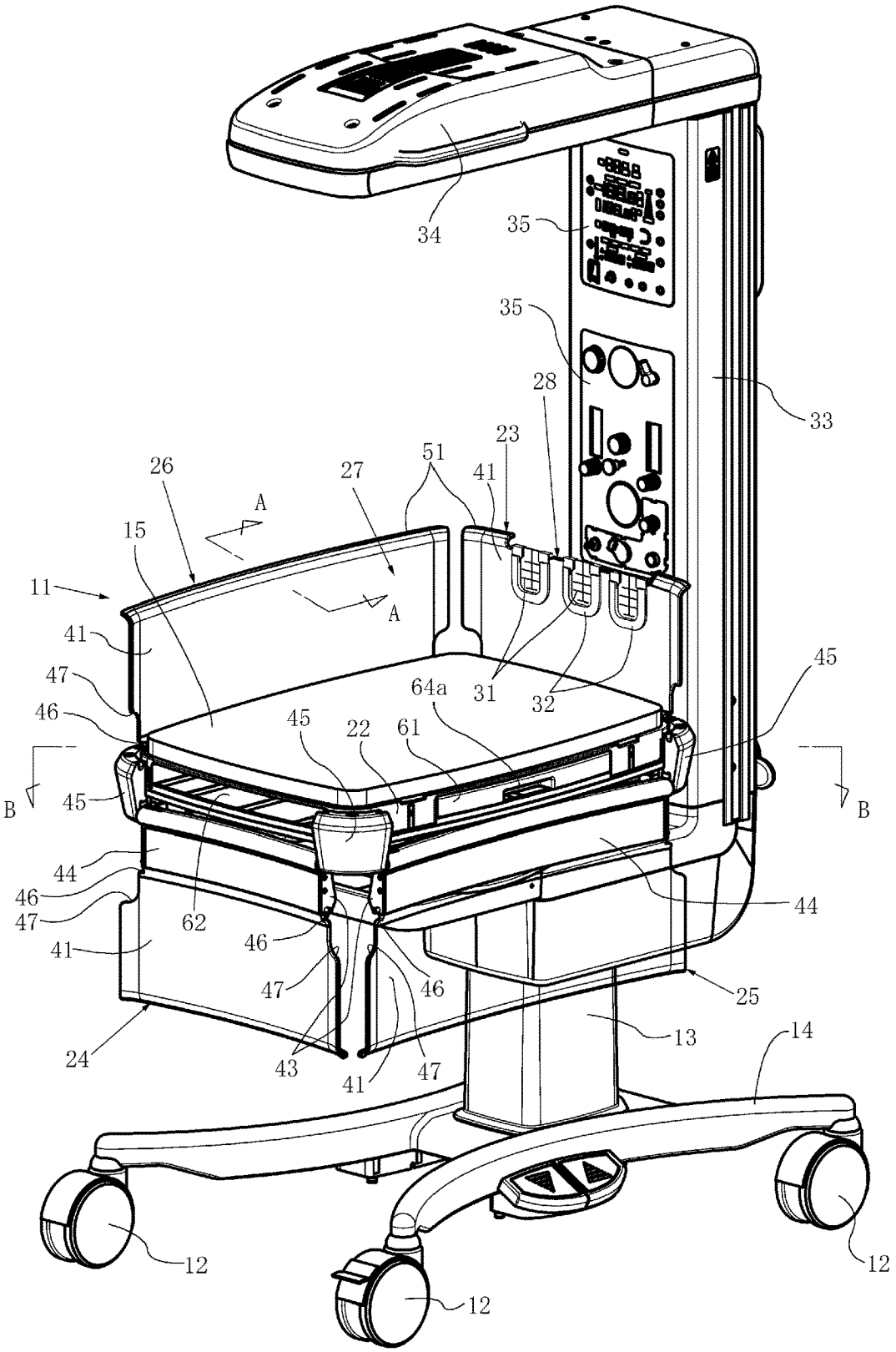
FIG. 2 is a perspective view showing the open type incubator shown in FIG. 1 while movable wall members in two directions are open.

As shown in FIGS. 1 and 2, an open type incubator 11 includes a carriage 14 to which wheels 12 and a main strut 13 are attached. More specifically, the wheels 12 are attached below the four corners of the carriage 14. The main strut 13 is attached on the carriage 14. An incubator base 21 is provided on the main strut 13. A flat container-shaped bed base (in other words, mattress tray) 22 is provided on the incubator base 21. Note that a mattress 15 on which an infant, for example, a newborn infant, can be laid down can be placed on the bed base 22. The incubator base 21 is provided with a fixed wall member (so-called fixed baby guard) 23 which is adjacent to an accessory support strut 33 provided on the main strut 13 and generally forms a wall member on the head side of the infant, a leg-side movable wall member (or movable baby guard) 24 which generally forms a wall member on the leg side of the infant, a left movable wall member (so-called movable baby guard) 25 which generally forms a wall member on the left side of the infant, and a right movable wall member (so-called movable baby guard) 26 which generally forms a wall member on the right side of the infant. These wall members are provided in a substantially rectangular shape as a whole when viewed from above.

As shown in FIGS. 1 and 2, an infant accommodation space 27 having a substantially rectangular parallelepiped shape with an open upper surface is constituted by the bed base 22 (in other words, mattress 15), and the fixed wall member 23 and movable wall members 24 to 26, each of which can take a substantially rectangular shape and can be substantially transparent. Therefore, the left movable wall member 25 and the right movable wall member 26 can have substantially the same dimensions. The fixed wall member 23 and the leg-side movable wall member 24 whose lengths are slightly shorter than those of the movable wall members 25 and 26, can have substantially the same dimensions except for three, for example, notch-shaped concave segments 28 provided in the upper side portion of the fixed wall member 23. The movable wall members 24 to 26 each can pivot forward and backward, about pivot support shafts 18, 19, or 20 (see FIG. 4) on the left and right sides or the front and rear sides provided in a region including a lower side and its vicinity in the substantially upward position (to be referred to as "the above-described upward position" hereinafter) shown in FIG. 1, between the above-described upward position shown in FIG. 1 and the substantially downward hanging position (to be referred to as "the above-described hanging position" hereinafter) shown in FIG. 2 (note that FIG. 2 shows the movable wall member 26 in the above-described upward position). Note that each of the fixed wall member 23 and the movable wall members 24 to 26 can be formed, substantially as a whole, from a substantially transparent plastic plate which can be formed by plastics molding using plastic such as acrylic resin as a material.

As shown in FIG. 1, a proper number (three in the embodiment shown in FIG. 1) of grommet members 32 each having cuts 31 for holding a cable can be attached to the notch-shaped concave segments 28 of the fixed wall member 23. A longitudinal member (not shown) such as an oxygen supply tube can be held in the cuts 31 while extending through the grommet member 32. An infrared heater 34 is provided on the upper end portion of the accessory support strut 33. Various kinds of measurement/control means 35 for body temperature, $SpO_2$, etc. are provided on the accessory support strut 33 so as to be substantially located between the infrared heater 34 and the infant accommodation space 27 when viewed from the front. More specifically, a body temperature control means of the measurement/control means 35 is configured to display a body temperature by receiving a signal from a body temperature probe which measures the body temperature of an infant, and control, for example, the heating temperature of the infrared heater 34. Note that $SpO_2$ indicates a measurement value obtained by measuring the oxygen (that is, $O_2$) saturation of blood (in other words, blood carried from the heart to the whole body) in the artery of the infant or the like using a pulse oximeter.

Figure 3:
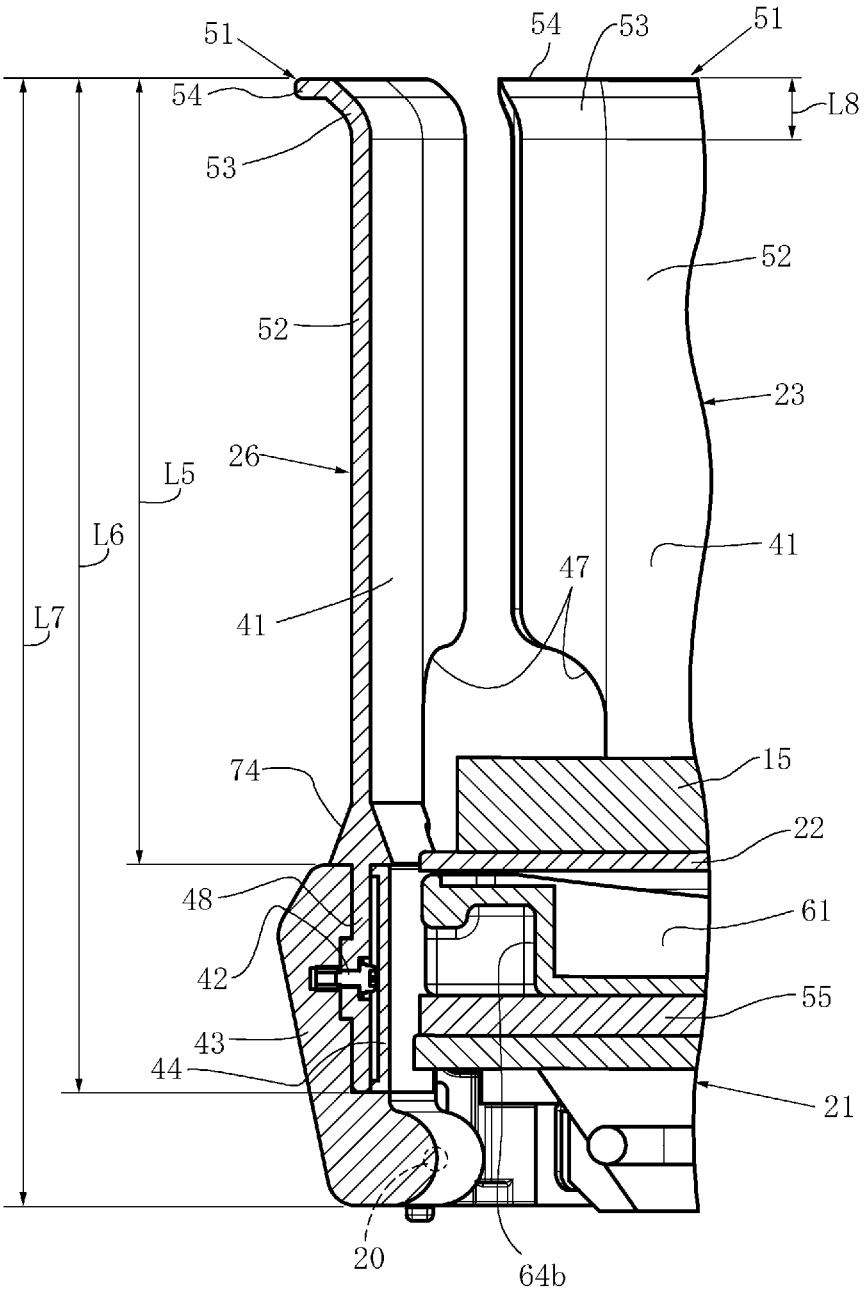
FIG. 3 is a partial cross-sectional view taken along a line A-A in FIG. 2.
Figure 6:
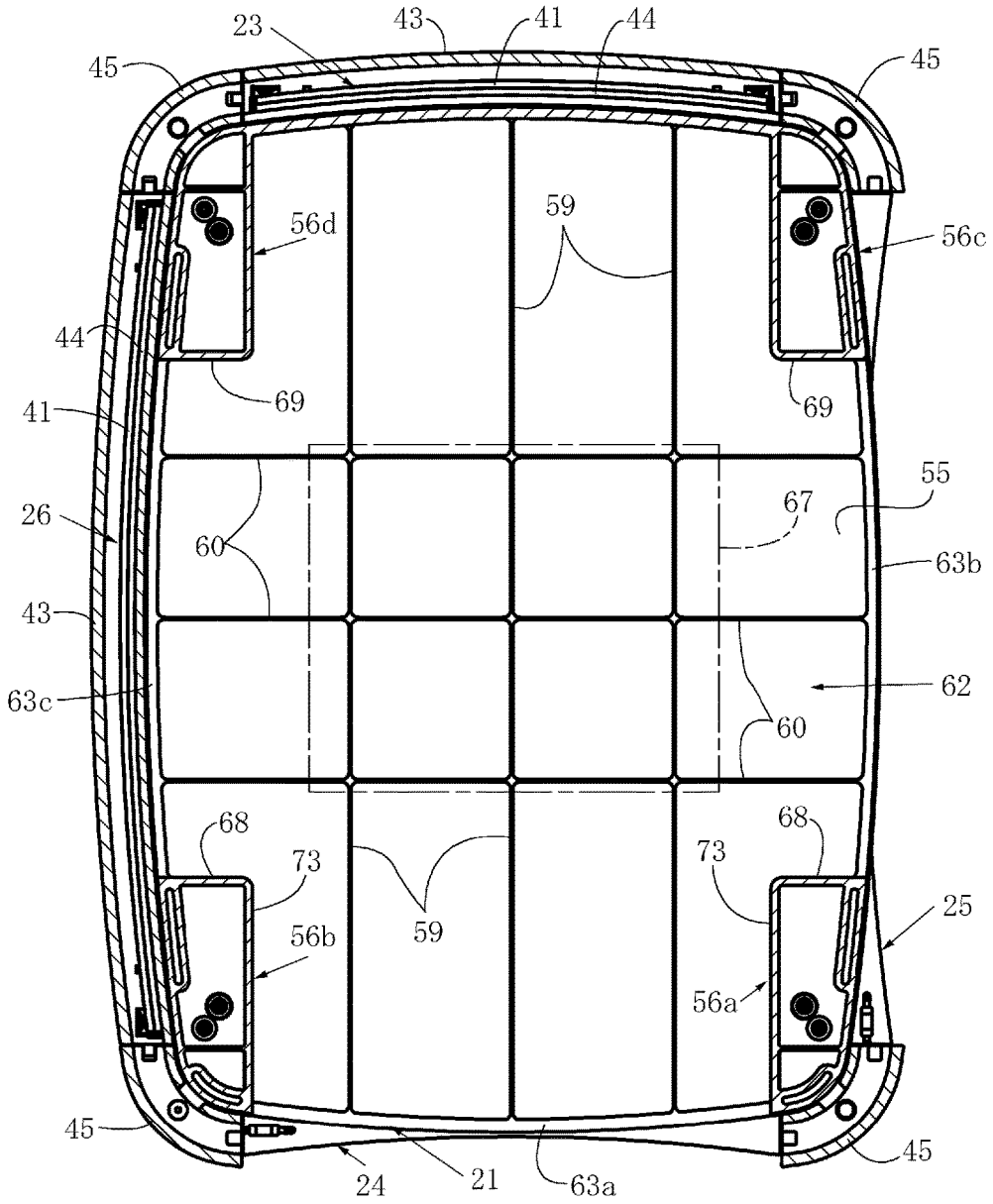
FIG. 6 is a partial cross-sectional view taken along a line B-B shown in FIG. 2.

2. Arrangements of Movable Wall Member Structure and Fixed Wall Member Structure As shown in FIGS. 1 to 3, each of the movable wall members 24 to 26 and the fixed wall member 23 includes a wall member main body 41, and a supporting member 43 to which a substantially lower end segment 48 of the wall member main body 41 is screwed and fixed by screws 42. The substantially entire inside surface of the substantially lower end segment 48 of each wall member main body 41 is covered by a cover member 44. As shown in FIGS. 1 and 6 and the like, each of the movable wall members 24 to 26 is pivotably attached to attachment members 45 by the pair of pivot support shafts 18, 19, or 20 in regions including the left and right sides or front and rear sides of the lower end portion of the supporting member 43 of the movable wall member 24, 25, or 26, and their vicinities. Note that the attachment members 45 are attached and fixed to the substantially four corners of the incubator base 21.

As shown in FIGS. 2 and 6 and the like, the fixed wall member 23 is attached and fixed to the attachment members 45 on the left and right sides of the fixed wall member 23 by a pair of left and right coupling members (these coupling members are not shown but correspond to the pivot support shafts 18, 19, or 20) in regions including the left and right sides of the lower end portion of the supporting member 43, and their vicinities. The pair of left and right coupling members are detachably engaged with the engaged portions (not shown) of the attachment members 45 provided on the left and right sides of the fixed wall member 23. As shown in FIGS. 1 and 3 and the like, a segment, adjacent to the upper surface of the supporting member 43 from substantially above, of the wall member main body 41 of each of the movable wall members 24 to 26 and fixed wall member 23 is formed as a thick segment 74 (FIG. 3) whose longitudinal section has a substantially triangular shape. Furthermore, the thick segment 74 is provided along the substantially full length in the substantially horizontal direction (in other words, the longitudinal direction) of each of the wall members 23 to 26. Therefore, to prevent dirty water, dust, or the like from entering between the lower end segment 48 and the supporting member 43 or between the lower end segment 48 and the cover member 44, one side portion of the lower end surface on each of the two sides of the thick segment 74 in the thickness direction abuts against the substantially upper surface of the supporting member 43 and the other side portion of the lower end surface abuts against the substantially upper surface of the cover member 44.

Figure 5:
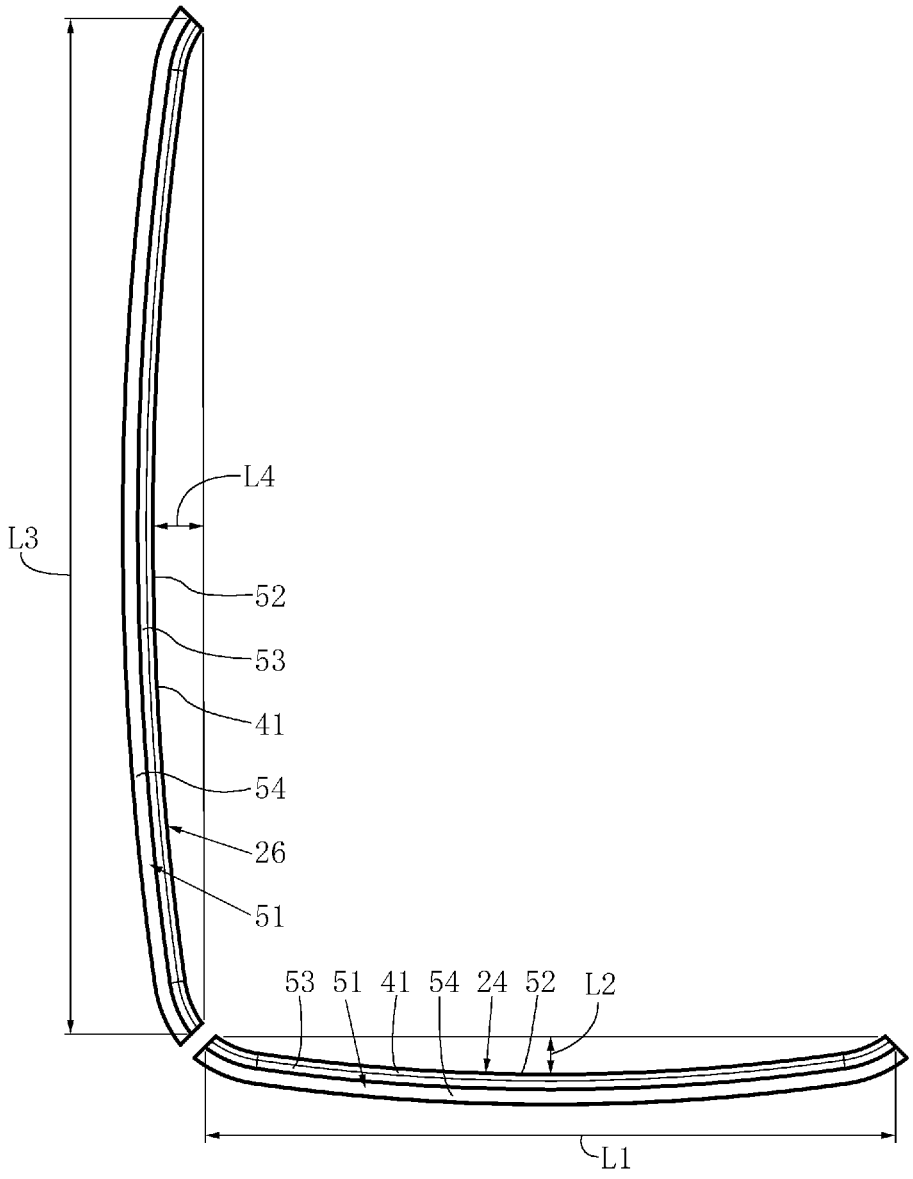
FIG. 5 is a plan view showing movable wall members in two directions shown in FIG. 1.

As shown in FIGS. 1 and 2 and the like, the fixed wall member 23 can have substantially the same shape as that of the leg-side movable wall member 24 except that the fixed wall member 23 includes the notch-shaped concave segments 28 and grommet members 32. The left movable wall member 25 can have substantially the same shape as that of the movable wall member 26. Note that to form recess segments for the four attachment members 45, notched segments 46 are formed in segments corresponding to the attachment members 45 in the two end segments of each of the supporting members 43 of the wall members 23 to 26. Therefore, the length of each supporting member 43 in the substantially horizontal direction is slightly shorter than that of a corresponding one of the wall members 23 to 26 in the substantially horizontal direction. A notched segment 47 connecting to each notched segment 46 is formed in a region including the lower end segment on each of the left and right sides or front and rear sides and its vicinity while the wall member main bodies 41 of the wall members 23 to 26 are in the above-described upward position. Furthermore, each of the movable wall members 24 to 26 and the fixed wall member 23 is curved to protrude to some extent in an arc shape from the inside to the outside when viewed substantially from above in the above-described upward position, as shown in FIGS. 5 and 6 and the like. In this case, when viewing, substantially from above, each of the wall members 23 to 26 in the above-described upward position, the center segment of each of the wall members 23 to 26 in the length direction has a substantially arc shape with a relatively large diameter (in other words, a substantially arc shape with a relatively small degree of curvature), and each of the two end segments of each of the wall members 23 to 26 in the length direction has a substantially arc shape with a relatively small diameter (in other words, a substantially arc shape with a relatively large degree of curvature). Each of the wall members 23 to 26 has a continuous curved surface substantially without any corners from one of the two end segments to the other through the center segment.

Figure 4:
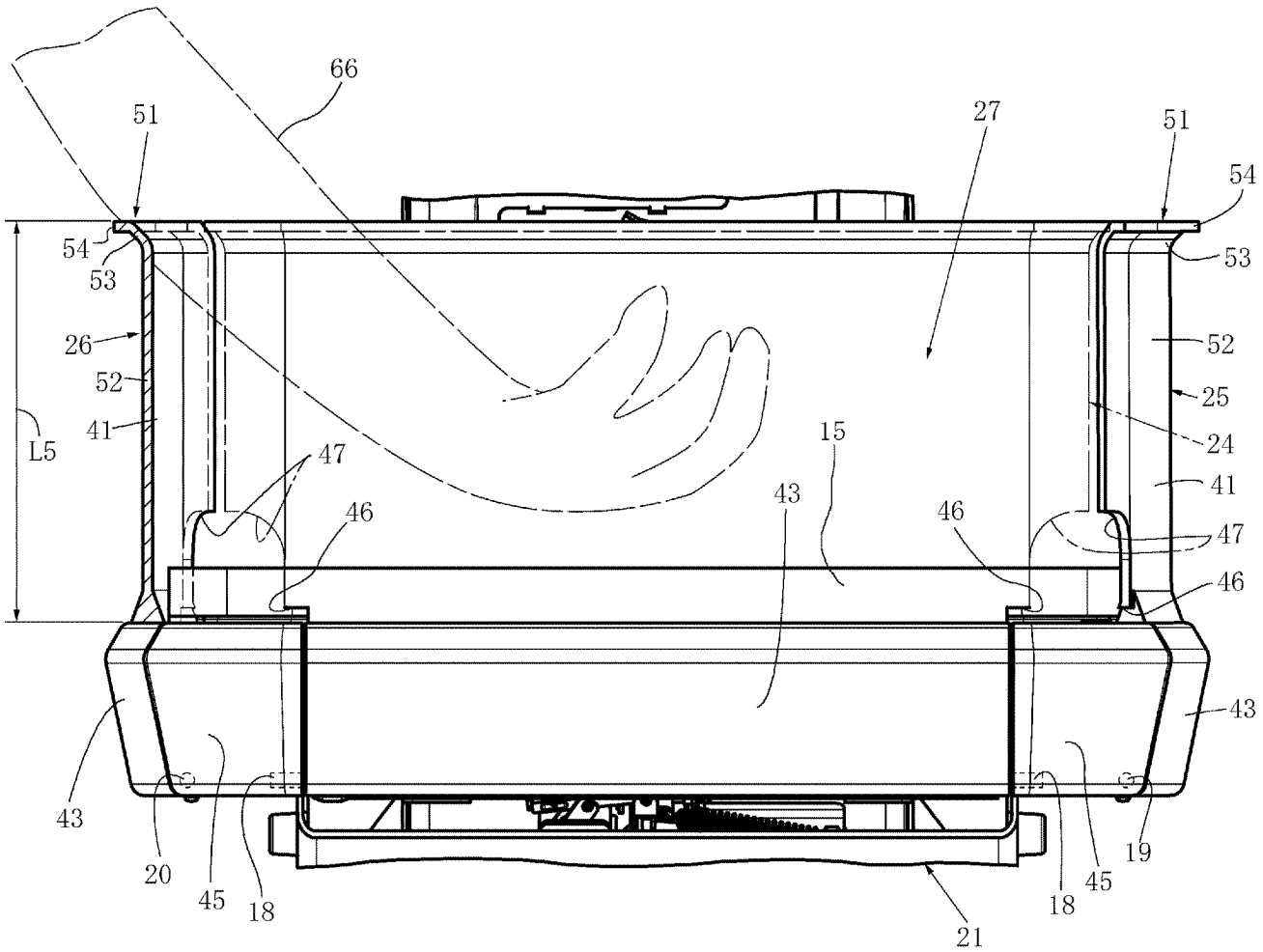
FIG. 4 is a partial front view showing the open type incubator shown in FIG. 1 by partially, longitudinally cutting the movable wall member.
Figure 9A:
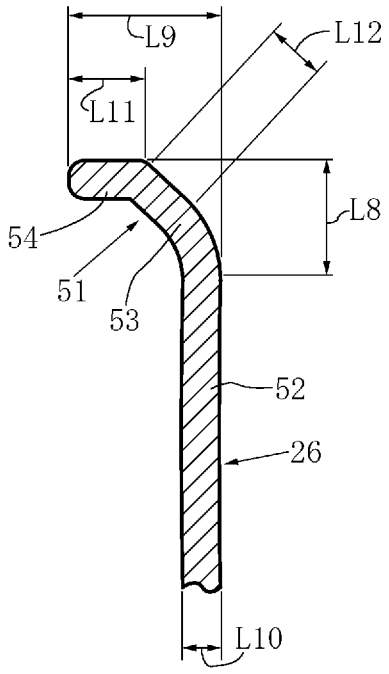
FIG. 9A is a cross-sectional view showing a region including the distal end segment of a right movable wall member shown in FIG. 3, and its vicinity.

More specifically (in other words, in this embodiment), a length L1 between the substantially left and right ends (in other words, in the substantially length direction) of each of the leg-side movable wall member 24 and fixed wall member 23 is approximately 455 mm, when viewed substantially from above. A length L2 in the substantially back-and-forth direction (in other words, in the substantially thickness direction) of the inside surface of each of the leg-side movable wall member 24 and fixed wall member 23 is approximately 25 mm, when viewed substantially from above. A length L3 between the substantially front and rear ends (in other words, in the substantially length direction) of each of the movable wall members 25 and 26 on the left and right sides is approximately 660 mm. A length L4 in the substantially right-and-left direction (in other words, in the substantially thickness direction) of the inside surface of each of the movable wall members 25 and 26 on the left and right sides is approximately 28 mm, when viewed substantially from above. A length L5 in the substantially vertical direction of a segment, protruding substantially upward from the supporting member 43, of the wall member main body 41 of each of the wall members 23 to 26 in the above-described upward position is approximately 190 mm, as shown in FIG. 4. Note that the lower end of the length L5 can be at a height substantially coinciding with the lower or upper surface of the bed base 22 or with a substantially middle segment between the lower surface and the upper surface. A length L6 in the substantially vertical direction of each of the movable wall members 24 to 26 and fixed wall member 23 in the above-described upward position is approximately 250 mm, as shown in FIGS. 3 and 4 and the like. A length L7 in the substantially vertical direction of the wall member main body 41 of each of the movable wall members 24 to 26 and fixed wall member 23 in the above-described upward position is approximately 280 mm. A length L8 in the substantially vertical direction of a bent segment 51 of each of the movable wall members 24 to 26 and fixed wall member 23 in the above-described upward position is approximately 30 mm, as shown in FIG. 9A and the like. An interval L9 between the distal end of the bent segment 51 and the inside surface of a substantially upward segment (to be referred to as an "upward segment" hereinafter) 52 of the bent segment 51 in the above-described upward position is approximately 20 mm, when viewed substantially from above. A thickness L10 of a segment (except for the bent segment 51) of the wall member main body 41 above the thick segment 74 is approximately 6 mm at the lower end and approximately 8 mm at the upper end. The thickness substantially continuously and gradually increases from the lower end (in other words, approximately 6 mm) to the upper end (in other words, approximately 8 mm). The thickness of the bent segment 51 can be substantially equal to that of the upper end, and is approximately 8 mm. By increasing the thickness of the bent segment 51 to be equal to that of the upper end while gradually increasing the thickness L10 from the lower end to the upper end, the bent segment 51 has the stable appearance in design, and the strength of the bent segment 51 also increases. Furthermore, by increasing the thickness of a segment on the lower end side of the segment of the wall member main body 41 above the thick segment 74 to be larger than that of a segment on the upper end side of the segment above the thick segment 74, it is possible to decrease the weight of each of the movable wall members 24 to 26 and fixed wall member 23, and reduce raw materials (more specifically, a plastic material such as acrylic resin) for manufacturing the wall members 23 to 26.

In terms of practical use, the length L1 between the substantially left and right ends (in other words, in a width direction) of each of the leg-side movable wall member 24 and fixed wall member 23 generally preferably falls within a range of 340 mm to 560 mm, more preferably a range of 360 mm to 545 mm, and most preferably a range of 380 mm to 530 mm, as shown in FIGS. 5 and 6 and the like. In terms of practical use, the length L2 in the substantially back-and-forth direction (in other words, a concave depth) of the inside surface of each of the leg-side movable wall member 24 and fixed wall member 23 generally preferably falls within a range of 16 mm to 34 mm, more preferably a range of 18 mm to 32 mm, and most preferably a range of 20 mm to 30 mm. In terms of practical use, the length L3 between the substantially front and rear ends (in other words, in the longitudinal direction) of each of the movable wall members 25 and 26 on the left and right sides generally preferably falls within a range of 500 mm to 830 mm, more preferably a range of 530 mm to 800 mm, and most preferably a range of 560 mm to 760 mm. In terms of practical use, the length L4 in the substantially right-and-left direction (in other words, a concave depth) of the inside surface of each of the movable wall members 25 and 26 on the left and right sides generally preferably falls within a range of 19 mm to 37 mm, more preferably a range of 21 mm to 35 mm, and most preferably a range of 23 mm to 33 mm.

In this embodiment, the ratio of the length L3 to the length L1 (that is, L3/L1) is approximately 1.45. In terms of practical use, L3/L1 generally preferably falls within a range of 1.2 to 1.8, more preferably a range of 1.25 to 1.7, and most preferably a range of 1.3 to 1.6. In this embodiment, the ratio of the length L4 to the length L2 (that is, L4/L2) is approximately 1.12. In terms of practical use, L4/L2 generally preferably falls within a range of 0.9 to 1.6, more preferably a range of 1 to 1.5, and most preferably a range of 1.1 to 1.4. In this embodiment, the ratio of the length L2 to the length L1 (that is, L2/L1) is approximately 0.055. In terms of practical use, L2/L1 generally preferably falls within a range of 0.035 to 0.08, more preferably a range of 0.04 to 0.075, and most preferably a range of 0.045 to 0.07. In this embodiment, the ratio of the length L4 to the length L3 (that is, L4/L3) is approximately 0.04. In terms of practical use, L4/L3 generally preferably falls within a range of 0.025 to 0.06, more preferably a range of 0.03 to 0.055, and most preferably a range of 0.035 to 0.05. Furthermore, in terms of practical use, the length L5 generally preferably falls within a range of 140 mm to 240 mm, more preferably a range of 150 mm to 230 mm, and most preferably a range of 160 mm to 220 mm.

In terms of practical use, the length L6 in the substantially vertical direction of each of the movable wall members 24 to 26 and fixed wall member 23 in the above-described upward position generally preferably falls within a range of 175 mm to 340 mm, more preferably a range of 190 mm to 320 mm, and most preferably a range of 200 mm to 300 mm, as shown in FIGS. 3 and 4 and the like. In terms of practical use, the length L7 in the substantially vertical direction of the wall member main body 41 in the above-described upward position generally preferably falls within a range of 220 mm to 360 mm, more preferably a range of 230 mm to 340 mm, and most preferably a range of 240 mm to 320 mm. In this embodiment, the ratio of the length L5 to the length L6 (that is, L5/L6) is approximately 0.75. In terms of practical use, L5/L6 generally preferably falls within a range of 0.5 to 1, more preferably a range of 0.55 to 0.9, and most preferably a range of 0.6 to 0.85. In this embodiment, the ratio of the length L7 to the length L6 (that is, L7/L6) is approximately 1.1. In terms of practical use, L7/L6 generally preferably falls within a range of 0.9 to 1.4, more preferably a range of 0.95 to 1.3, and most preferably a range of 1 to 1.25. In this embodiment, the ratio of the length L5 to the length L7 (that is, L5/L7) is approximately 0.68. In terms of practical use, L5/L7 generally preferably falls within a range of 0.5 to 0.9, more preferably a range of 0.55 to 0.85, and most preferably a range of 0.6 to 0.8.

In terms of practical use, the length (that is, the height) L8 in the substantially vertical direction of the bent segment 51 of each of the movable wall members 24 to 26 and fixed wall member 23 in the above-described upward position generally preferably falls within a range of 21 mm to 39 mm, more preferably a range of 23 mm to 37 mm, and most preferably a range of 25 mm to 35 mm, as shown in FIGS. 3 and 9A and the like. In terms of practical use, the interval L9 generally preferably falls within a range of 10 mm to 30 mm, more preferably a range of 13 mm to 27 mm, and most preferably a range of 15 mm to 25 mm. In this embodiment, the thickness L10 of a segment (including an inclined segment 53 and a horizontal segment 54) of the wall member main body 41 of each of the wall members 23 to 26 substantially above the thick segment 74 in the above-described upward position changes within a range of approximately 6 mm to approximately 8 mm. In terms of practical use, the thickness L10 generally preferably falls within a range of 3 mm to 14 mm even if the thickness changes or is substantially constant, more preferably falls within a range of 4 mm to 12 mm even if the thickness changes or is substantially constant, and most preferably changes within a range of 5 mm to 10 mm or is substantially constant.

In a region including the upper end segment of the wall member main body 41 of each of the movable wall members 24 to 26 and fixed wall member 23 (except for the notch-shaped concave segment 28) in the above-described upward position and its vicinity, the bent segment 51 is integrally formed in the wall member main body 41 as part of the wall member main body 41, as shown in FIGS. 3, 5, and 9A and the like. Each bent segment 51 includes the inclined segment 53 integrally formed at the upper end of the upward segment 52 of the wall member main body 41 in the above-described upward position, and the substantially horizontal segment (to be referred to as the "horizontal segment" hereinafter) 54 integrally formed on the upper end side of the inclined segment 53 to be substantially horizontal in the above-described upward position. Note that in the above-described upward position, the inclined segment 53 can be inclined at, for example, an angle of approximately 45° from the substantially lower side to the substantially upper side from the inside surface to the outside surface of the upward segment 52. Furthermore, the horizontal segment 54 can substantially horizontally extend from the upper end of the inclined segment 53 to the outside in the above-described upward position. Referring to FIGS. 3 and 9A, a boundary between the inside surface of the upward segment 52 and that of the inclined segment 53 is rounded to have a radius R1 of approximately 14 mm. A boundary between the inside surface of the inclined segment 53 and the upper surface of the horizontal segment 54 is rounded to have a radius R2 of approximately 2 mm. In addition, the upper and lower ends of the distal end segment of the horizontal segment 54 are each rounded to have a radius R3 of approximately 2 mm. Therefore, a portion from the inside surface in a region including the upper end portion of the upward portion 52 and its vicinity to the lower surface of the horizontal segment 54 through the inclined surface on the upper side (that is, inside) of the inclined segment 53 and the upper surface of the horizontal segment 54 is a continuous curved surface substantially without any corners.

In this embodiment, a width (in other words, a length in a direction from the substantially inside surface to the substantially outside surface of each of the wall members 23 to 26) L11 on the upper surface side of the horizontal segment 54 of the bent segment 51 in the above-described upward position is approximately 4 mm by excluding the rounded portion of the inner and outer ends of the upper surface of the horizontal segment 54. In terms of practical use, the length L11 generally preferably falls within a range of 2 mm to 10 mm, more preferably a range of 2.5 mm to 9 mm, and most preferably a range of 3 mm to 8 mm. In this embodiment, a width (in other words, a length in a direction from the substantially inside surface of each of the wall members 23 to 26 to the substantially upper surface of the horizontal segment 54) L12 on the upper side of the inclined segment 53 of the bent segment 51 in the above-described upward position is approximately 21 mm by excluding the rounded portion of the upper and lower ends of the inside surface of the inclined segment 53. In terms of practical use, the length L12 generally preferably falls within a range of 10 mm to 34 mm, more preferably a range of 13 mm to 30 mm, and most preferably a range of 16 mm to 26 mm. In terms of practical use, the radius R1 of the boundary between the inside surface of the upward segment 52 and that of the inclined segment 53 generally preferably falls within a range of 10 mm to 18 mm, more preferably a range of 11 mm to 17 mm, and most preferably a range of 12 mm to 16 mm. In terms of practical use, each of the radius R2 of the boundary between the inside surface of the inclined segment 53 and the upper surface of the horizontal segment 54, and the radius R3 of the upper and lower ends of the distal end segment of the horizontal segment 54 generally preferably falls within a range of 1.4 mm to 2.6 mm, more preferably a range of 1.5 mm to 2.5 mm, and most preferably a range of 1.6 mm to 2.4 mm.

Figure 9B:
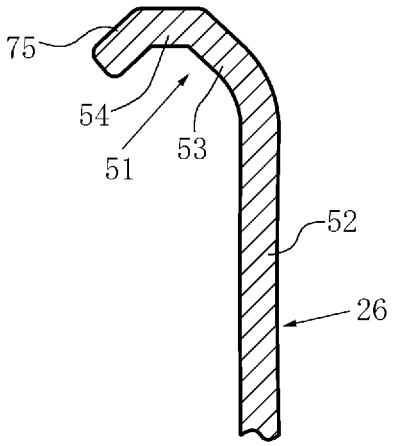
FIG. 9B is a cross-sectional view showing a region including a distal end segment and its vicinity according to the first modification of the right movable wall member shown in FIG. 9A.
Figure 9C:
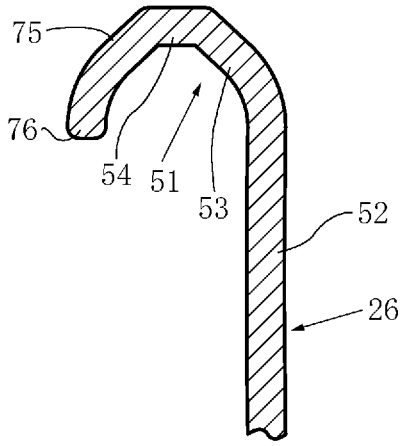
FIG. 9C is a cross-sectional view showing a region including a distal end segment and its vicinity according to the second modification of the right movable wall member shown in FIG. 9A.
Figure 9D:
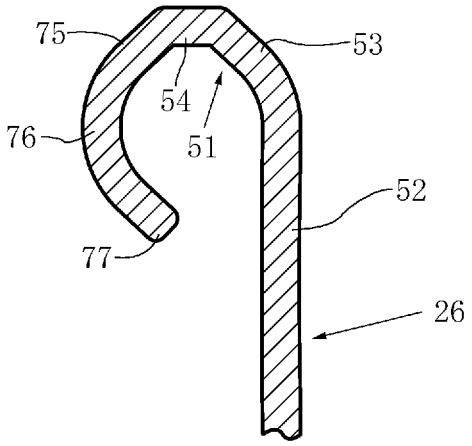
FIG. 9D is a cross-sectional view showing a region including a distal end segment and its vicinity according to the third modification of the right movable wall member shown in FIG. 9A.

The shape of the bent segment 51 of each of the movable wall members 24 to 26 and fixed wall member 23 need not be limited to the shape shown in FIGS. 3, 5, and 9A and the like, and can be changed to various shapes, as shown in, for example, FIGS. 9B to 9D. Note that in the first modification shown in FIG. 9B, the bent segment 51 is different from that in the embodiment shown in FIG. 9A and the like in that an inclined segment 75 on the distal end side as the second inclined segment is integrally formed at the end of the horizontal segment 54. A boundary between the upper surface on the proximal end side of the second inclined segment 75 and the upper surface of the distal end of the horizontal segment 54 can be rounded to have a radius substantially equal to the radius R2 (that is, for example, approximately 2 mm). The upper and lower ends of the distal end segment of the second inclined segment 75 can each be rounded to have a radius substantially equal to the radius R3 (that is, for example, approximately 2 mm). Therefore, a segment from the inside surface in a region including the upper segment of the upward segment 52 and its vicinity to the inclined surface on the upper side of the inclined segment 75 on the distal end side through the inclined surface on the upper side of the inclined segment 53 and the upper surface of the horizontal segment 54 is a continuous curved surface substantially without any corners. In the second modification shown in FIG. 9C, the bent segment 51 is different from that in the first modification shown in FIG. 9B in that a hanging segment 76 is integrally formed at the distal end of the inclined segment 75 on the distal end side. A boundary between the upper end of the outside surface of the hanging segment 76 and the upper surface on the distal end side of the second inclined segment 75 can be rounded to have a radius substantially equal to the radius R1 (that is, for example, approximately 14 mm). The outer and inner ends of the distal end segment of the hanging segment 76 can each be rounded to have a radius substantially equal to the radius R3. Furthermore, in the third modification shown in FIG. 9D, the bent segment 51 is different from that in the second modification shown in FIG. 9C in that an inclined segment 77 on the distal end side as the third inclined segment is integrally formed at the distal end of the hanging segment 76. A boundary between the upper end of the outside surface of the inclined segment 77 on the distal end side and the lower end of the outside surface of the hanging segment 76 can be rounded to have a radius substantially equal to the radius R1 (that is, for example, approximately 14 mm). The outer and inner ends of the distal end segment of the inclined segment 77 can each be rounded to have a radius substantially equal to the radius R3.

3. Arrangement of Cassette Tray Mounting Structure

As shown in FIGS. 2, 3, and 6 and the like, the incubator base 21 includes an upper-side support plate member 55 as a tray support means. On upper surfaces at the substantially four corners of the upper-side support plate member 55, four strut members 56*a* to 56*d* for attaching and fixing the bed base 22 are provided integrally or individually with the upper-side support plate member 55. The four attachment members 45 are attached and fixed to the substantially four corners of the incubator base 21, respectively. Furthermore, the bed base 22 is attached and fixed on the four strut members 56*a* to 56*d*. Consequently, a tray accommodation space 62 capable of accommodating a cassette tray 61 is formed between the bed base 22 and the upper-side support plate member 55. The tray accommodation space 62 includes a leg-side tray loading/unloading port (in other words, a front tray loading/unloading port) 63*a*, a left tray loading/unloading port 63*b*, and a right tray loading/unloading port 63*c*. Note that the leg-side tray loading/unloading port 63*a* is formed by a space existing between the strut members 56*a* and 56*b*. The left tray loading/unloading port 63*b* is formed by a space existing between the strut members 56*a* and 56*c*. The right tray loading/unloading port 63*c* is formed by a space existing between the strut members 56*b* and 56*d*. Note that as shown in FIG. 6 and the like, on the upper-side support plate member 55, three grooves 59 extending along the full length in the substantially back-and-forth direction and three grooves 60 extending along the full length in the substantially right-and-left direction are formed to improve the moldability of the upper-side support plate member 55 formed by plastics molding using plastic such as polypropylene resin or ABS resin as a material, and to prevent deformation of the upper-side support plate member 55.

Figure 7:
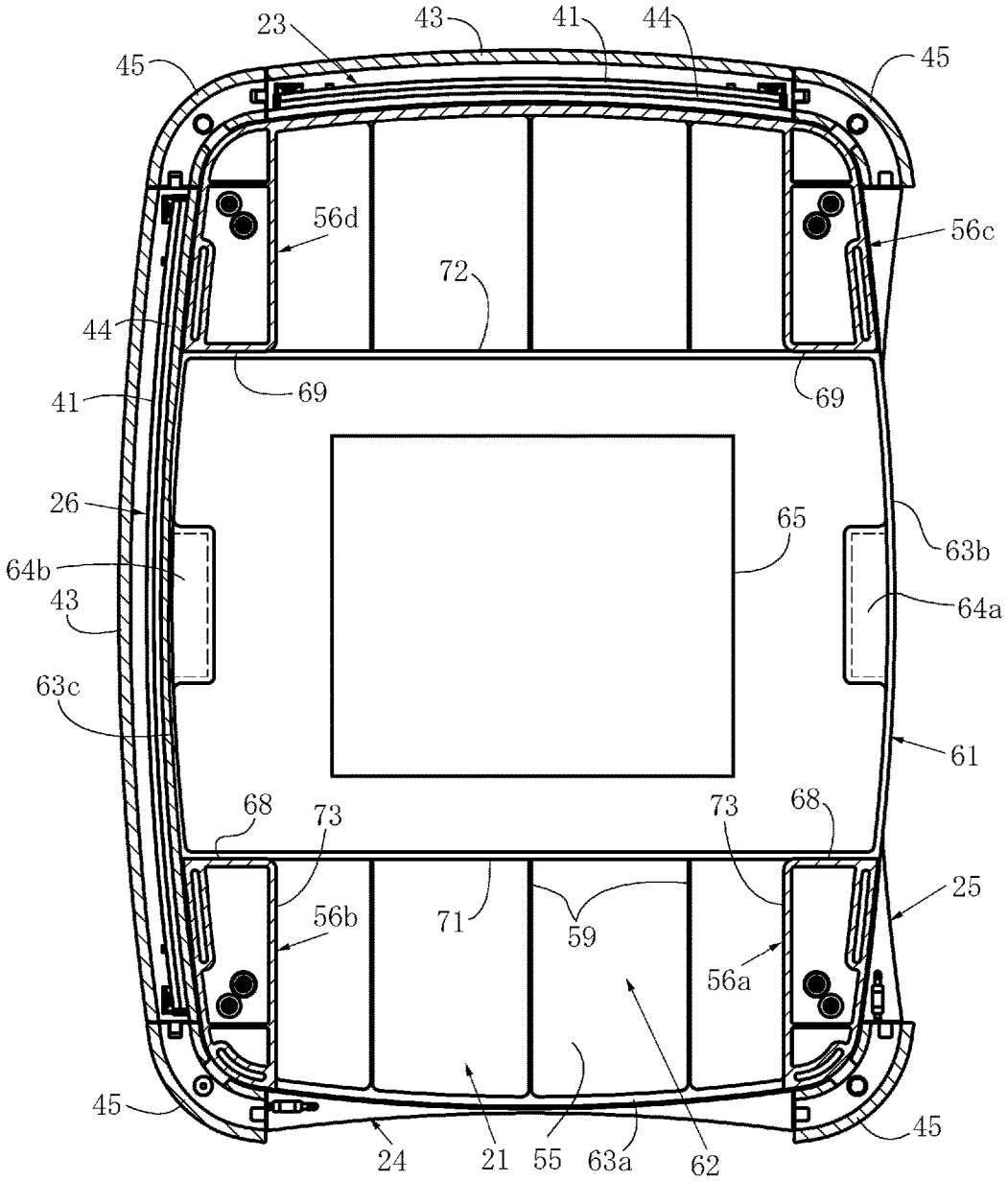
FIG. 7 is a cross-sectional view similar to that of FIG. 6 while an X-ray tray is mounted from the first direction.
Figure 8:
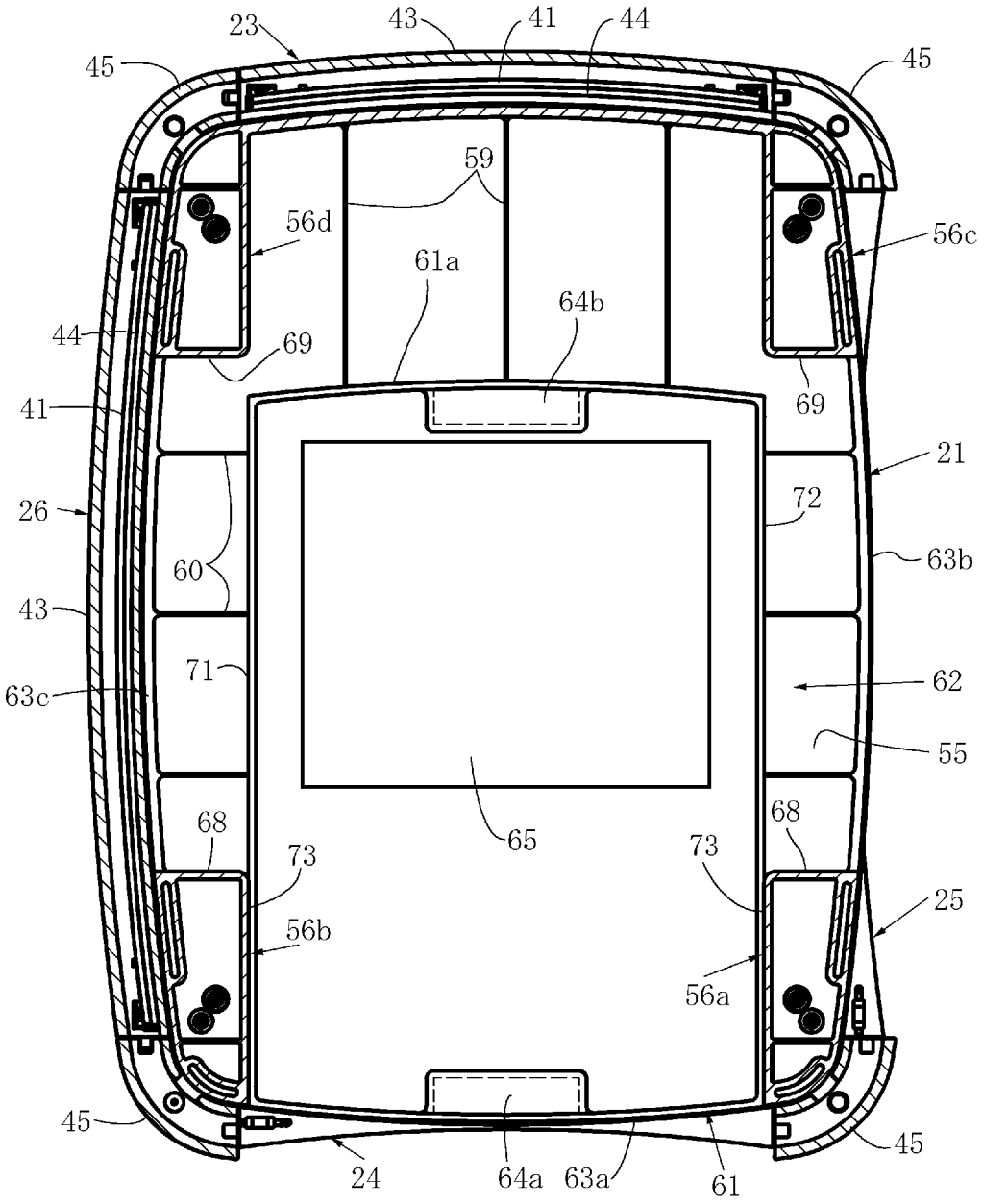
FIG. 8 is a cross-sectional view similar to that of FIG. 6 while the X-ray tray is mounted from the second direction.

As shown in FIGS. 2, 7, and 8 and the like, the cassette tray 61 can have a substantially rectangular tray shape when viewed from above. On the side surfaces of the two end segments of the cassette tray 61 in the longitudinal direction, a pair of grip segments 64*a* and 64*b* each having a substantially concave shape are provided. A cassette 65 that can accommodate imaging materials such as an imaging film and CCD image sensor (that is, an image sensor using a charge coupled device) which can be used for X-ray imaging or the like is arranged on the cassette tray 61. The width of the cassette tray 61 can be substantially equal to the interval between the strut members 56*a* and 56*c* (in other words, the interval between the strut members 56*b* and 56*d*) or slightly smaller than the interval. Alternatively, the width of the cassette tray 61 can be substantially equal to the interval between the strut members 56*a* and 56*b* or slightly smaller than the interval. The interval between the strut members 56*a* and 56*c*, that between the strut members 56*b* and 56*d*, and that between the strut members 56*a* and 56*b* can be substantially equal to each other.

4. Operations of Movable Wall Member Structure and Fixed Wall Member Structure

As shown in FIGS. 2 and 6 and the like, the fixed wall member 23 is stationarily held in the above-described upward position when it is detachably attached and fixed to the pair of left and right attachment members 45 fixed to the incubator base 21 on the left and right sides of the fixed wall member 23. To the contrary, when each of the leg-side movable wall member 24 and the left and right movable wall members 25 and 26 pivots forward from the above-described upward position shown in FIG. 1 to the above-described hanging position exemplified in FIG. 2 with respect to the movable wall members 24 and 25, the lock by a lock means (not shown) which locks the forward pivoting movement of each of the movable wall members 24 to 26 is released. The operator can then make each of the movable wall members 24 to 26 pivot forward from the above-described upward position to the above-described hanging position by making each of the movable wall members 24 to 26 pivot forward about the corresponding pair of pivot support shafts 18, 19, or 20, as needed. Note that the forward pivoting movement of each of the movable wall members 24 to 26 can be performed at low speed by the damper function of a damper (not shown) capable of suppressing the pivoting speed of the forward pivoting movement. To make each of the movable wall members 24 to 26 pivot backward from the above-described hanging position to the above-described upward position, the operator need only manually make each of the movable wall members 24 to 26 pivot backward about the corresponding pair of pivot support shafts 18, 19, or 20 of the movable wall member 24, 25, or 26.

When the operator lays an infant, for example, a newborn infant down on the mattress 15 of the open type incubator 11 or holds up the infant from the mattress 15, he/she inserts his/her arm 66 to the infant accommodation space 27, as shown in FIG. 4. In this case, the arm 66 of the operator can abut against the upper end segments of the movable wall members 24 to 26 and fixed wall member 23, as shown in FIG. 4. However, the upper end segment of each of the movable wall members 24 to 26 forms the bent segment 51 while the upper end segment of the fixed wall member 23 except for the notch-shaped concave segments 28 forms the bent segment 51. The inclined segment 53 and the horizontal segment 54 are sequentially, continuously formed at the upper end of the upward segment 52 in the bent segment 51, as shown in FIG. 3, FIG. 9A (this matter is substantially same in FIGS. 9B-9D), and so on. In addition, joints between the inside surface of the upward segment 52, the upper surface of the inclined segment 53, and the upper surface of the horizontal segment 54, and the distal end segment of the upper surface of the horizontal segment 54 are rounded. Therefore, even if the arm 66 of the operator abuts against the upper end segment (especially, the horizontal segment thereof) of the wall member main body 41 relatively hard, there is no risk that the operator feels a pain or the arm 66 gets hurt. In addition, each of the movable wall members 24 to 26 and fixed wall member 23 slightly swells in an arc shape from the inside to the outside when viewed substantially from above, as shown in FIGS. 5 and 6 and the like. Therefore, each of the movable wall members 24 to 26 and fixed wall member 23 can have a sufficient strength as the external wall member of the infant accommodation space 27 of the open type incubator 11 in combination with the wall member main body 41 including the bent segment 51. Furthermore, these two kinds of effects can be obtained not only in the case of the bent segment 51 shown in FIG. 9A but also in the case of the bent segments 51 shown in FIGS. 9B, 9C, and 9D. The bent segment 51 shown in each of FIGS. 9B, 9C, and 9D has an equally fine appearance or finer appearance, as compared with that shown in FIG. 9A. As shown in FIGS. 5 and 6 and the like, each of the movable wall members 24 to 26 and fixed wall member 23 is curved to protrude to some extent in an arc shape from the inside to the outside when viewed substantially from above in the above-described upward position. Especially, the degree of curvature is larger in the two end segments in the length direction of each of the wall members 23 to 26 than in the center segment in the length direction. Therefore, as the infant accommodation space 27 becomes wider to some extent, a region including the infant accommodation space 27 and its vicinity looks nicer, and the strength of the wall members 23 to 26 improves.

5. Operation of Cassette Tray Mounting Structure

To store the cassette tray 61 in the cassette tray accommodation space 62 of the open type incubator 11, it is only necessary to insert the cassette tray 61 toward the cassette tray accommodation space 62 from one of the three tray loading/unloading ports 63*a* to 63*c*. In this case, when the operator inserts the cassette tray 61 from the tray loading/unloading port 63*b* to the cassette tray accommodation space 62, he/she makes the left movable wall member 25 pivot forward from the above-described upward position to the above-described hanging position, as shown in FIGS. 2 and 6 and the like. Subsequently, the operator grips the grip segment 64*a* and the like by the hands and the like, and makes the cassette tray 61 slide on the upper-side support plate member 55 of the incubator base 21, thereby inserting the cassette tray 61 to the cassette tray accommodation space 62. In this case, the operator inserts the cassette tray 61 to the cassette tray accommodation space 62 along the substantially longitudinal direction of the cassette tray 61 from a side of the cassette tray 61 on which one of the pair of front and rear grip segments 64*a* and 64*b* is provided. At this time, each of a set of rear surfaces 68 of the strut members 56*a* and 56*b* and a set of front surfaces 69 of the strut members 56*c* and 56*d* serves as a position holding portion serving also as a guide portion, and abuts against a corresponding one of the side wall members 71 and 72 on the long wall sides of the cassette tray 61. As a result, the cassette tray 61 is arranged symmetrically in the right-and-left direction in the cassette tray accommodation space 62 in FIG. 7, as shown in FIGS. 2 and 7 and the like.

When the operator takes out the cassette tray 61, which is accommodated in the cassette tray accommodation space 62 as shown in FIG. 7, from the cassette tray accommodation space 62, he/she grips the grip segment 64*a* or 64*b* by the hand or the like, and makes the cassette tray 61 slide on the upper-side support plate member 55, thereby pulling out the cassette tray 61 to the right or left side in FIG. 7 along the substantially longitudinal direction of the cassette tray 61. In this case as well, each of the set of rear surfaces 68 of the strut members 56*a* and 56*b* and the set of front surfaces 69 of the strut members 56*c* and 56*d* serves as a guide portion to guide a corresponding one of the side wall members 71 and 72 on the long wall sides of the cassette tray 61. Note that a rectangle 67 indicated by chain lines indicates an estimated cassette mounting position in FIG. 6. Referring to FIGS. 7 and 8, the cassette 65 is arranged at substantially the same position as that of the rectangle 67 when viewed from above.

When the operator inserts the cassette tray 61 to the cassette tray accommodation space 62 from the tray loading/unloading port 63*c*, he/she need only perform substantially the same operation except that the cassette tray 61 is inserted from the tray loading/unloading port 63*b* to be symmetrical in the right-and-left direction, as described above, and a detailed description thereof will be omitted. Furthermore, when the operator takes out, from the cassette tray accommodation space 62, the cassette tray 61 accommodated in the cassette tray accommodation space 62, he/she grips the grip segment 64*a* or 64*b* by the hand, and makes the cassette tray 61 slide on the upper-side support plate member 55, thereby relatively correctly and relatively readily pulling out the cassette tray 61 to the right or left side (in other words, the side convenient for the operator at this time) in FIG. 7. With respect to this point, it is possible to relatively readily insert the cassette tray 61 to the cassette tray accommodation space 62 by performing the inverse operation of the operation performed when pulling out the cassette tray 61.

When the operator inserts the cassette tray 61 from the tray loading/unloading port 63*a* to the cassette tray accommodation space 62 or takes out the cassette tray 61 in the cassette tray accommodation space 62 from the tray loading/unloading port 63*a*, it is only necessary to perform the following operation, as compared with a case in which the cassette tray 61 is inserted or taken out from the tray loading/unloading port 63*b*. That is, the operator first moves in advance the cassette 65 toward an insertion end 61*a* of the cassette tray 61, as shown in FIG. 8. To do this, on the upper surface or the like of the cassette tray 61, an instruction line, an instruction groove, an instruction concave segment, or the like for arranging the cassette 65 at the substantially center position on the upper surface of the cassette tray 61, as shown in FIG. 7, can be formed in advance. Furthermore, on the upper surface or the like of the cassette tray 61, an instruction line, an instruction groove, an instruction concave segment, or the like for arranging the cassette 65 at a position near one end of the upper surface of the cassette tray 61 in the length direction, as shown in FIG. 8, can be formed in advance. Subsequently, as shown in FIGS. 2 and 8 and the like, the operator makes the leg-side movable wall member 24 pivot forward from the above-described upward position to the above-described hanging position. The operator inserts the cassette tray 61 to the cassette tray accommodation space 62 from the tray loading/unloading port 63*a* along the substantially longitudinal direction of the cassette tray 61, similarly to the above-described case in which the operator inserts the cassette tray 61 to the cassette tray accommodation space 62 from the tray loading/unloading port 63*b*. At this time, the inside surface 73 of each of the strut members 56*a* and 56*b* serves as a position holding portion serving also as a guide portion, and abuts against a corresponding one of the side wall members 72 and 71 on the long wall sides of the cassette tray 61.

When the operator takes out the cassette tray 61, which is accommodated in the cassette tray accommodation space 62 as shown in FIG. 8, from the cassette tray accommodation space 62, he/she grips the grip segment 64*a* by the hand or the like, and makes the cassette tray 61 slide on the upper-side support plate member 55, thereby pulling out the cassette tray 61 along the substantially longitudinal direction of the cassette tray 61 downward in FIG. 8. In this case as well, the inside surface 73 of the strut members 56*a* and 56*b* serve as guide portions to guide the side wall members 72 and 71 on the long wall sides of the cassette tray 61, respectively.

Having described a specific preferred embodiment and first to third modified embodiments of the present invention with reference to the accompanying drawings, it is to be understood that the present invention is not limited to the embodiments, and that various changes and modifications may be effected therein by one skilled in the art without departing from the scope or spirit of the invention as defined in the appended claims.

For example, in the above-described preferred embodiment and modified embodiments, the present invention is applied to the open type incubator. However, the present invention is applicable to not only the open type incubator but also an open type incubator serving also as a closed type incubator. In this case, it is possible to provide a top hood which can selectively cover the infant accommodation space 27 from above, is movable in the substantially vertical direction and has a substantially box-cover shape. The top hood can be formed from a top member which can be substantially transparent, and an upper wall member which protrudes substantially downward from a region including the periphery of the top member and its vicinity, can be substantially transparent, and has a substantially rectangular shape when viewed from above. When the top hood moves up, the upper surface of the infant accommodation space 27 is opened and the incubator thus serves as an open type incubator, and when the top hood moves down, the upper surface of the infant accommodation space 27 is closed and the incubator thus serves as a closed type incubator.

In the above-described embodiment and the above-described modifications, among the four baby guards 23 to 26 (in other words, the three movable wall members 24 to 26 and one fixed wall member 23), the three baby guards 24 to 26 are movable and the remaining one baby guard 23 is fixed. However, all the four baby guards 23 to 26 can be movable or fixed. Alternatively, two baby guards can be movable and the remaining two baby guards can be fixed. Furthermore, one baby guard can be movable and the remaining three baby guards can be fixed.

In the above-described embodiment and the above-described modifications, the thick segment 74 of the wall member main body 41 is formed to have a longitudinal section in a substantially isosceles triangular shape. The longitudinal section of the thick segment 74 may have other various shapes which preferably have a smaller width on the upper side, such as a substantially pentagonal shape, a substantially trapezoidal shape, a substantially semi-elliptical shape, a substantially semi-oval shape, or substantially semi-circular shape. Furthermore, in the above-described embodiment and the above-described modifications, the lower end segment at each of the two sides in the thickness direction of the thick segment 74 is formed in the thick segment. However, in terms of preventing entry of the body fluid of an infant, for example, a newborn infant, only the lower end portion of the inside portion in the thickness direction of the thick segment 74 may be formed in the thick segment. In this case, the longitudinal section of the thick segment can have a substantially right-angled triangular shape, a substantially semi-pentagonal shape, a substantially semi-trapezoidal shape, a substantially ¼-elliptical shape (in other words, the shape of one of pieces obtained by cutting an elliptical shape crosswise; the same applies to the following description), a substantially ¼-oval shape, a substantially ¼-circular shape, or the like. Even if the lower end segment at each of the two sides in the thickness direction of the thick segment 74 is formed to have a large thickness, the thick segment of the lower portion of the inside portion in the thickness direction of the thick segment 74 need not always have substantially the same shape as that of the thick segment of the lower portion of the outside portion. For example, one of these thick segments can be formed in a substantially right-angled triangular shape, and the other can be formed in a substantially ¼-oval shape.

The invention claimed is:

1. An incubator comprising first, second, third, and fourth baby guards, wherein at least three of the baby guards are moveable, form part of the periphery of an infant accommodation space, and pivot forward and backward between an upward position and a downward position, and each of the moveable baby guards:

(a) is attached to a supporting member that is pivotably attached to an incubator base;

(b) includes a thick segment having a substantially triangular cross-sectional shape, the lower surface of the thick segment being in contact with a cover member covering a side of a lower end segment of the moveable baby guard opposite from a side of the baby guard attached to the supporting member; and (c) comprises a vertically extending segment and a bent segment formed along a substantially full length of an upper end of the vertically extending segment of the baby guard, wherein the bent segment extends obliquely upward and away from the vertically extending segment when the baby guard is in an upward position and the bent segment comprises:

(i) a first inclined segment integrally connected to the upper end of the vertically extending segment, wherein the first inclined segment extends toward the outside of the infant accommodation space when the incubator is viewed from above; and (ii) a horizontal segment integrally connected to the end of the first inclined segment distal to the vertically extending segment, the horizontal segment further extending the bent segment away from the vertically extending segment and toward the outside of the infant accommodation space when the incubator is viewed from above.

2. The incubator of claim 1, wherein (a) at least part of the bent segment is 3 mm to 14 mm thick;

(b) at least part of the bent segment is 21 mm to 39 mm high; and (c) at least part of the bent segment is 10 mm to 30 mm in length.

3. The incubator of claim 1, wherein:

(a) at least part of the bent segment is 4 mm to 12 mm thick;

(b) at least part of the bent segment is 23 mm to 37 mm high; and (c) at least part of the bent segment 13 mm to 27 mm in length.

4. The incubator of claim 1, wherein:

(a) at least part of the bent segment is 5 mm to 10 mm thick;

(b) at least part of the bent segment is 25 mm to 35 mm high; and (c) at least part of the bent segment is 15 mm to 25 mm in length.

5. The incubator of claim 1, wherein:

(a) the bent segment comprises a second inclined segment integrally connected to the horizontal segment at the end of the horizontal segment distal to the first inclined segment; and (b) when the baby guard is in the upward position, the second inclined segment extends obliquely downward with respect to the horizontal segment.

6. The incubator of claim 5, wherein, when the baby guard is in the upward position:

(a) the bent segment includes a hanging segment integrally connected to the end of the second inclined segment distal to the horizontal segment; and (b) the hanging segment extends downward from the second inclined segment.

7. The incubator of claim 1, wherein:

(a) the first and second baby guards face each other, and the third and fourth baby guards face each other;

(b) the lengths of each of the first and second baby guards is longer than the lengths of each of the third and fourth baby guards;

(c) the first and second baby guards are each 500 mm to 830 mm long and 19 mm to 37 mm thick;

(d) the third and fourth baby guards are each 340 mm to 560 mm long and 16 to 34 mm thick;

(e) the ratio of the length of the first and second baby guards to the length of the third and fourth baby guards is 1.2 to 1.8;

(f) the height of each baby guard, when in the upward position, is 175 mm to 340 mm;

(g) each baby guard is curved to protrude in an arc shape toward the outside of the infant accommodation space when the incubator is viewed from above;

(i) the ratio of the thickness of the first and second baby guards to the length of the first and second baby guards is 0.025 to 0.06; and (j) the ratio of the thickness of the third and fourth baby guards to the length of the third and fourth baby guards is 0.035 to 0.08.

8. The incubator of claim 1, wherein:

(a) the first and second baby guards face each other, and the third and fourth baby guards face each other;

(b) the lengths of each of the first and second baby guards is longer than the lengths of each of the third and fourth baby guards;

(c) the first and second baby guards are each 530 mm to 800 mm long and 21 mm to 35 mm thick;

(d) the third and fourth baby guards are each 360 mm to 545 mm long and 18 to 32 mm thick;

(e) the ratio of the length of the first and second baby guards to the length of the third and fourth baby guards is 1.25 to 1.7;

(f) the height of each baby guard in the upward position is 190 mm to 320 mm;

(g) each baby guard is curved to protrude in an arc shape toward the outside of the infant accommodation space when the incubator is viewed from above;

(i) the ratio of the thickness of the first and second baby guards to the length of the first and second baby guards is 0.03 to 0.055; and (j) the ratio of the thickness of the third and fourth baby guards to the length of the third and fourth baby guards is 0.04 to 0.075.

9. The incubator of claim 1, wherein:

(a) the first and second baby guards face each other, and the third and fourth baby guards face each other;

(b) the lengths of each of the first and second baby guards is longer than the lengths of each of the third and fourth baby guards;

(c) the first and second baby guards are each 560 mm to 760 mm long and 23 mm to 33 mm thick;

(d) the third and fourth baby guards are each 380 mm to 530 mm long and 20 to 30 mm thick;

(e) the ratio of the length of the first and second baby guards to the length of the third and fourth baby guards is 1.3 to 1.6;

(f) the height of each baby guard in the upward position is 200 mm to 300 mm;

(g) each baby guard is curved to protrude in an arc shape toward the outside of the infant accommodation space when the incubator is viewed from above;

(i) the ratio of the thickness of the first and second baby guards to the length of the first and second baby guards is 0.035 to 0.05; and (j) the ratio of the thickness of the third and fourth baby guards to the length of the third and fourth baby guards is 0.045 to 0.07.

10. The incubator of claim 1, wherein the thickness of the moveable baby guard gradually increases from the upper end of the thick segment to the upper end of the vertically extending segment.

11. The incubator of claim 1, further comprising a cassette tray accommodation space and a bed base with the cassette tray accommodation space located between the incubator base and the bed base, the cassette tray accommodation space comprising three tray loading/unloading ports selected from the group consisting of a front tray loading/unloading port, a rear tray loading/unloading port, a left tray loading/unloading port, and a right tray loading/unloading port, wherein the tray loading/unloading ports are each closed by a moveable baby guard when the baby guard is in an upward position and are opened when the baby guard is in the downward position.

* * * * *